US009638221B2

(12) United States Patent
Masuta et al.

(10) Patent No.: US 9,638,221 B2
(45) Date of Patent: May 2, 2017

(54) FLUID PRESSURE CYLINDER

(71) Applicant: KYB Corporation, Tokyo (JP)

(72) Inventors: Yuzo Masuta, Gifu (JP); Norio Yuzawa, Gifu (JP)

(73) Assignee: KYB Corporation, Tokyo (JP)

( * ) Notice: Subject to any disclaimer, the term of this patent is extended or adjusted under 35 U.S.C. 154(b) by 0 days.

(21) Appl. No.: 14/898,152

(22) PCT Filed: Jun. 26, 2014

(86) PCT No.: PCT/JP2014/066931

§ 371 (c)(1),
(2) Date: Dec. 14, 2015

(87) PCT Pub. No.: WO2015/002055

PCT Pub. Date: Jan. 8, 2015

(65) Prior Publication Data

US 2016/0138622 A1 May 19, 2016

(30) Foreign Application Priority Data

Jul. 5, 2013 (JP) ..... 2013-141622

(51) Int. Cl.

| | |
|---|---|
| ***F15B 15/22*** | (2006.01) |
| ***F15B 15/14*** | (2006.01) |
| *B66F 9/22* | (2006.01) |

(52) U.S. Cl.

CPC ..... *F15B 15/22* (2013.01); *F15B 15/149* (2013.01); *F15B 15/1457* (2013.01); *B66F 9/22* (2013.01)

(58) Field of Classification Search

CPC ..... F15B 15/22; F15B 15/222; F15B 15/227; F15B 15/149; F15B 15/1466;

(Continued)

(56) References Cited

U.S. PATENT DOCUMENTS 3,257,912 A * 6/1966 Vander Horst ..... F15B 9/10 91/376 R
3,519,011 A * 7/1970 Pennanen ..... F16K 17/00 137/102

(Continued)

FOREIGN PATENT DOCUMENTS

| | | |
|---|---|---|
| JP | 07-039273 B | 5/1995 |
| JP | 09-317717 A | 12/1997 |
| JP | 2011-012458 A | 1/2011 |

*Primary Examiner* — Michael Leslie
*Assistant Examiner* — Dustin T Nguyen
(74) *Attorney, Agent, or Firm* — Rabin & Berdo, P.C.

(57) ABSTRACT

A fluid pressure cylinder includes: a piston rod; a cushioning chamber that decreases in capacity in accordance with extension of the fluid pressure cylinder; a communication passage that allows the cushioning chamber and an in-rod chamber to communicate with each other; a throttle passage that exerts a cushioning function by applying resistance to a flow of a working fluid from the cushioning chamber to the in-rod chamber; a check valve that is provided in a piston, allows the in-rod chamber and a driving chamber to communicate with each other, and has a checking function for permitting only a flow of the working fluid from the in-rod chamber to the driving chamber; and a pilot passage that is formed in the piston and disables the checking function by guiding a pressure in the cushioning chamber to the check valve as a pilot pressure.

5 Claims, 4 Drawing Sheets

(58) Field of Classification Search
CPC .... F15B 15/204; F15B 13/021; F15B 13/027; F15B 11/048; F15B 21/005; F15B 2211/755; F16F 9/48; F16F 9/50; B66F 9/22
USPC ..... 91/6, 19, 22, 25, 26, 27, 31, 407, 408, 91/409, 396, 52; 92/8, 9, 10, 11, 12, 81, 92/82, 85 R, 85 B, 109, 110, 111, 112, 92/15, 142, 143
See application file for complete search history.

(56) References Cited

U.S. PATENT DOCUMENTS 4,550,899 A * 11/1985 Holley ..... F16F 9/0209 137/102
4,721,289 A * 1/1988 Hennells ..... F16F 9/43 137/102
5,784,943 A * 7/1998 Kahra ..... E04G 23/08 91/28
5,960,696 A * 10/1999 Niwa ..... F15B 11/024 91/27
2011/0049811 A1* 3/2011 Sueyoshi ..... F15B 15/1452 277/434
2012/0031262 A1* 2/2012 Nakanishi ..... B66F 9/22 91/52

* cited by examiner

FLUID PRESSURE CYLINDER

TECHNICAL FIELD

The present invention relates to a fluid pressure cylinder.

BACKGROUND ART

A device for raising and lowering a load, such as a forklift, has a hydraulic cylinder for moving the load up and down by extension and retraction through supply and discharge of a hydraulic pressure. The hydraulic cylinder is single-acting. The hydraulic cylinder extends as a hydraulic pressure is supplied to a hydraulic chamber inside a cylinder tube, and retracts as a hydraulic pressure in the hydraulic chamber is discharged.

JP 9-317717A describes a hydraulic cylinder that has a cushioning function for alleviating impact by suppressing an ascending speed of a piston when reaching a stroke end. The cushioning function is realized by an orifice that is provided in a piston rod of the hydraulic cylinder in the vicinity of the piston, and that allows the inside and outside of the piston rod to communicate with each other. That is to say, when cushioning oil, which is working oil between a cylinder tube and the piston rod, flows into the inside of the piston rod via the orifice in the vicinity of the stroke end, flow resistance is applied to the working oil. As a result, the ascending speed of the piston is reduced.

Also, a communication passage and a check valve are built in the piston. The communication passage allows the inside of the piston rod and a hydraulic chamber to communicate with each other. The check valve is provided in the communication passage and permits only the flow from the inside of the piston rod to the hydraulic chamber. In this way, in a case where there is excess cushioning oil due to upward leakage of the working oil from the hydraulic chamber past an oil seal provided on an outer circumference of the piston, the extra working oil can be returned to the hydraulic chamber.

SUMMARY OF INVENTION

Depending on how the hydraulic cylinder is used, the cushioning oil leaks downward to a hydraulic chamber side past the oil seal on the piston. With the foregoing conventional technique, the action of the check valve prohibits the supply of the working oil from the hydraulic chamber to the inside of the piston rod, thereby giving rise to the possibility of a shortage of the cushioning oil.

It is an object of the present invention to provide a fluid pressure cylinder that is capable of preventing a shortage of cushioning oil.

According to one aspect of the present invention, a single-acting fluid pressure cylinder extends upward in accordance with supply of a working fluid to a driving chamber below a piston sliding inside a cylinder tube, and has a cushioning function for suppressing an extension operation before the piston reaches an extension stroke end. The fluid pressure cylinder includes a piston rod that is joined to an upper portion of the piston with an in-rod chamber defined between the piston rod and the piston; a cushioning chamber defined between the piston rod and the cylinder tube, the cushioning chamber being configured to decrease in capacity in accordance with extension of the fluid pressure cylinder; a communication passage formed in the piston rod, the communication passage being configured to allow the cushioning chamber and the in-rod chamber to communicate with each other; a throttle passage formed below the communication passage, the throttle passage being configured to exert the cushioning function by applying resistance to a flow of the working fluid from the cushioning chamber to the in-rod chamber; a check valve provided in the piston, the check valve being configured to allow the in-rod chamber and the driving chamber to communicate with each other, the check valve being configured to have a checking function for permitting only a flow of the working fluid from the in-rod chamber to the driving chamber; and a pilot passage formed in the piston, the pilot passage being configured to disable the checking function by guiding a pressure in the cushioning chamber to the check valve as a pilot pressure.

DESCRIPTION OF EMBODIMENTS

Described below is an embodiment of the present invention with reference to the accompanied drawings.

First, a description is given of a first embodiment.

Figure 1:
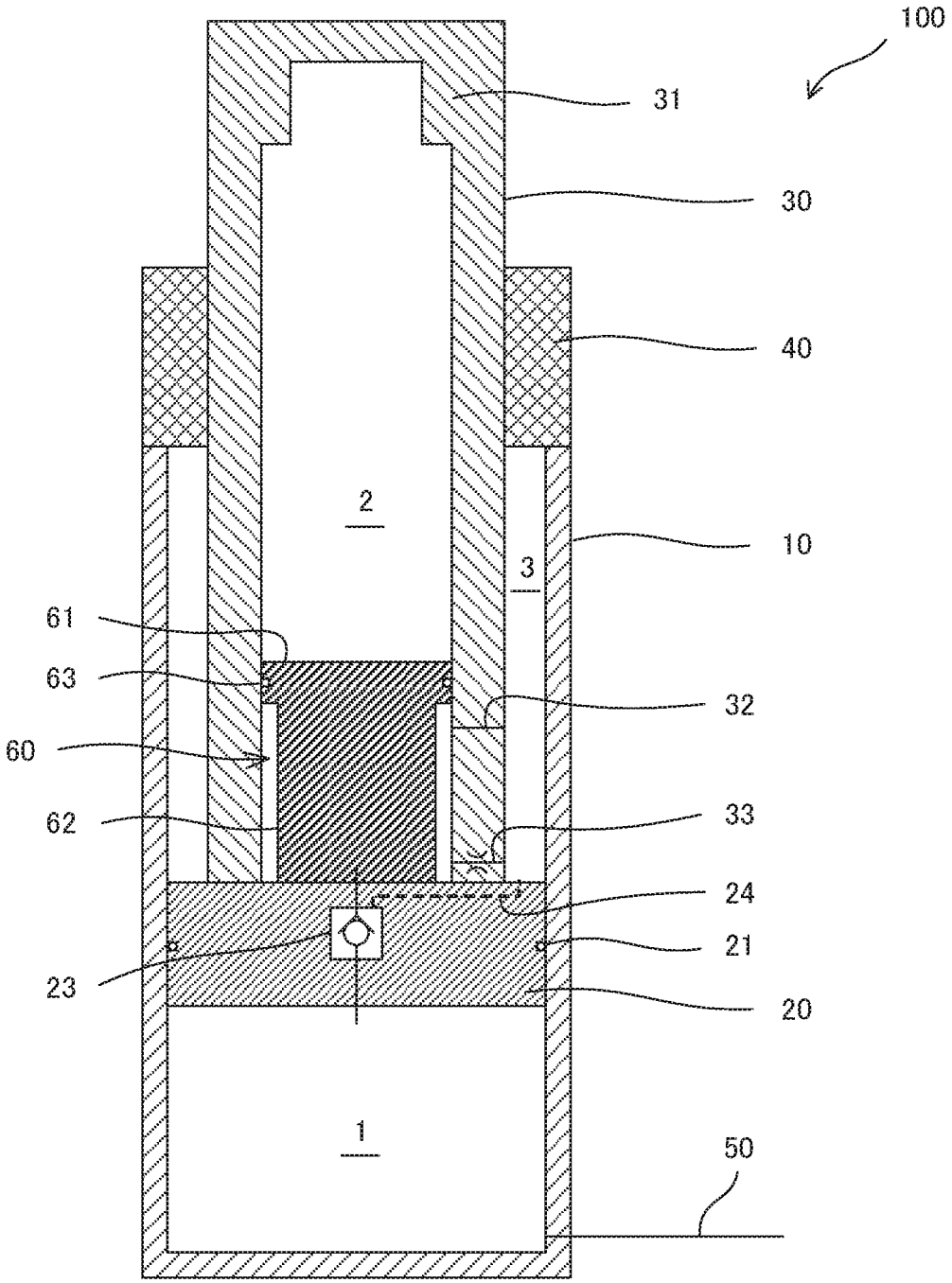
FIG. 1 is a cross-sectional view showing a fluid pressure cylinder according to a first embodiment of the present invention.

FIG. 1 is a cross-sectional view showing a fluid pressure cylinder 100 according to the present embodiment.

The fluid pressure cylinder 100 is a single-acting fluid pressure cylinder 100 including a tubular cylinder tube 10, a piston 20, a piston rod 30, and a cylinder head 40. The piston 20 slidably fits inside the cylinder tube 10. The piston rod 30 is joined to an upper portion of the piston 20. The cylinder head 40 fits on an upper end of the cylinder tube 10 and supports the piston rod 30 about an axis thereof so that the piston rod 30 is slidable.

The fluid pressure cylinder 100 is used in a raising/lowering device, such as a forklift, as a lift cylinder for raising and lowering a load. When the fluid pressure cylinder 100 is mounted on the forklift, the cylinder tube 10 and the piston rod 30 are fixed to a vehicle body (not shown). During use, the orientation of the fluid pressure cylinder 100 is such that, as shown in FIG. 1, the piston rod 30 is arranged on the upper portion of the piston 20, and an axial direction of the cylinder tube 10 substantially coincides with a vertical direction.

Inside the cylinder tube 10, a driving chamber 1 is defined below the piston 20. A supply/discharge passage 50 is connected to the driving chamber 1. A working fluid from a fluid pressure source (not shown) is supplied/discharged to the driving chamber 1 via the supply/discharge passage 50. If a working fluid pressure in the driving chamber 1 increases, the piston 20 and the piston rod 30 are driven upward, and the fluid pressure cylinder 100 undergoes an extension operation. On the other hand, if the working fluid pressure in the driving chamber 1 decreases, the piston 20 and the piston rod 30 move downward under their own weights, and the fluid pressure cylinder 100 undergoes a retraction operation. It should be noted that the working fluid is, for example, oil and other water-soluble alternative liquids.

The piston rod 30 is formed as a bottomed tube. One open end of the piston rod 30 is joined to the piston 20, whereas the other end thereof is positioned outside the cylinder tube 10. Inside the piston rod 30, an in-rod chamber 2 is defined between the piston rod 30 and the piston 20. A reduced diameter part 31 is formed in a bottom portion (in FIG. 1, an upper end portion) of the piston rod 30. The reduced diameter part 31 has a smaller inner diameter than other parts of the piston rod 30. It should be noted that the space defined inside the reduced diameter part 31 is also a part of the in-rod chamber 2.

The cylinder head 40 is attached to an upper open end of the cylinder tube 10 and supports the piston rod 30. An annular cushioning chamber 3 is defined between the cylinder tube 10 and an outer circumferential surface of the piston rod 30. The capacity of the cushioning chamber 3 decreases as the fluid pressure cylinder 100 extends, and increases as the fluid pressure cylinder 100 retracts. The capacity of the in-rod chamber 2 is set to be equal to or larger than the capacity of the cushioning chamber 3 at the time of full retraction of the fluid pressure cylinder 100, which maximizes the cushioning chamber 3.

A communication passage 32 is formed in a side surface of the piston rod 30. The communication passage 32 allows the cushioning chamber 3 and the in-rod chamber 2 to communicate with each other. Furthermore, a throttle passage 33 is formed in the side surface of the piston rod 30 below the communication passage 32. The throttle passage 33 allows the cushioning chamber 3 and the in-rod chamber 2 to communicate with each other. The throttle passage 33 applies resistance to the flow of the working fluid from the cushioning chamber 3 to the in-rod chamber 2. In this way, a cushioning function is exerted for suppressing the extension operation of the fluid pressure cylinder 100 before the piston 20 reaches an extension stroke end.

A free piston 60 is housed in the in-rod chamber 2 inside the piston rod 30. The free piston 60 can slide up and down in the in-rod chamber 2. The free piston 60, which serves as a separator member, includes a sliding contact part 61 and a small diameter part 62. The sliding contact part 61 is in sliding contact with an inner wall surface of the in-rod chamber 2. The small diameter part 62 is arranged below the sliding contact part 61 and has a smaller diameter than the sliding contact part 61.

A seal ring 63 that seals the spaces above and below the free piston 60 fits on an outer circumference of the sliding contact part 61. The working fluid fills a side below the free piston 60, whereas gas (e.g., air) is stored in a side above the free piston 60. That is to say, from a state in which the free piston 60 is situated at the lowest point where it is in contact with an upper surface of the piston 20, the free piston 60 slides up and down in accordance with a fluid level of the working fluid in the in-rod chamber 2.

An axial dimension of the small diameter part 62 is set such that, when the free piston 60 is situated at the lowest point, an opening portion of the communication passage 32 faces the small diameter part 62. In this way, opening portions of the communication passage 32 and the throttle passage 33 are always exposed to a side below the seal ring 63, regardless of the position of the free piston 60.

A seal ring 21 that seals between the driving chamber 1 and the cushioning chamber 3 fits on an outer circumference of the piston 20. The seal ring 21 suppresses the working fluid in the driving chamber 1 from leaking to the cushioning chamber 3, and also suppresses the working fluid in the cushioning chamber 3 from leaking to the driving chamber 1.

A check valve 23 is built in the piston 20. The check valve 23 allows the in-rod chamber 2 and the driving chamber 1 to communicate with each other, and has a checking function for permitting only the flow of the working fluid from the in-rod chamber 2 to the driving chamber 1. The checking function causes the check valve 23 to close when a working fluid pressure in the in-rod chamber 2 is lower than the working fluid pressure in the driving chamber 1. The check valve 23 opens when the working fluid pressure in the in-rod chamber 2 is higher than the working fluid pressure in the driving chamber 1.

A pilot passage 24, which guides a working fluid pressure in the cushioning chamber 3 to the check valve 23 as a pilot pressure, is also formed in the piston 20. When the pilot pressure supplied from the cushioning chamber 3 via the pilot passage 24 exceeds a predetermined valve opening pressure, the checking function of the check valve 23 is disabled, thereby causing the check valve 23 to open.

As described above, the space inside the cylinder tube 10 is partitioned into the driving chamber 1 defined below the piston 20, the cushioning chamber 3 defined outside the piston rod 30, and the in-rod chamber 2 defined inside the piston rod 30.

The driving chamber 1 is a pressure chamber filled with the working fluid. The pressure therein fluctuates in accordance with supply and discharge of the working fluid supplied from the fluid pressure source. The cushioning chamber 3 is a pressure chamber filled with the working fluid. The capacity thereof increases and decreases in accordance with sliding of the piston 20. The in-rod chamber 2 is a pressure chamber filled with the working fluid and the air that are separated from each other by the free piston 60. The in-rod chamber 2 exerts a pressure storage function due to the free piston 60 sliding in accordance with a pressure change.

A description is now given of operations of the fluid pressure cylinder 100.

FIG. 1 shows a state in which the working fluid is supplied from the fluid pressure source to the driving chamber 1 via the supply/discharge passage 50. Supply of the working fluid causes the pressure in the driving chamber 1 to increase. Accordingly, the piston 20 and the piston rod 30 are driven upward. In association with the ascent of the piston 20, the capacity of the cushioning chamber 3 decreases. Hence, the working fluid corresponding to the reduced capacity flows into the in-rod chamber 2 via the communication passage 32.

Meanwhile, as the in-rod chamber 2 communicates with the cushioning chamber 3 via the communication passage 32, the pressure in the in-rod chamber 2 increases in association with the increase in the pressure in the cushioning chamber 3. The increase in the pressure in the in-rod chamber 2 causes the free piston 60 to slide upward while compressing the air.

Figure 2:
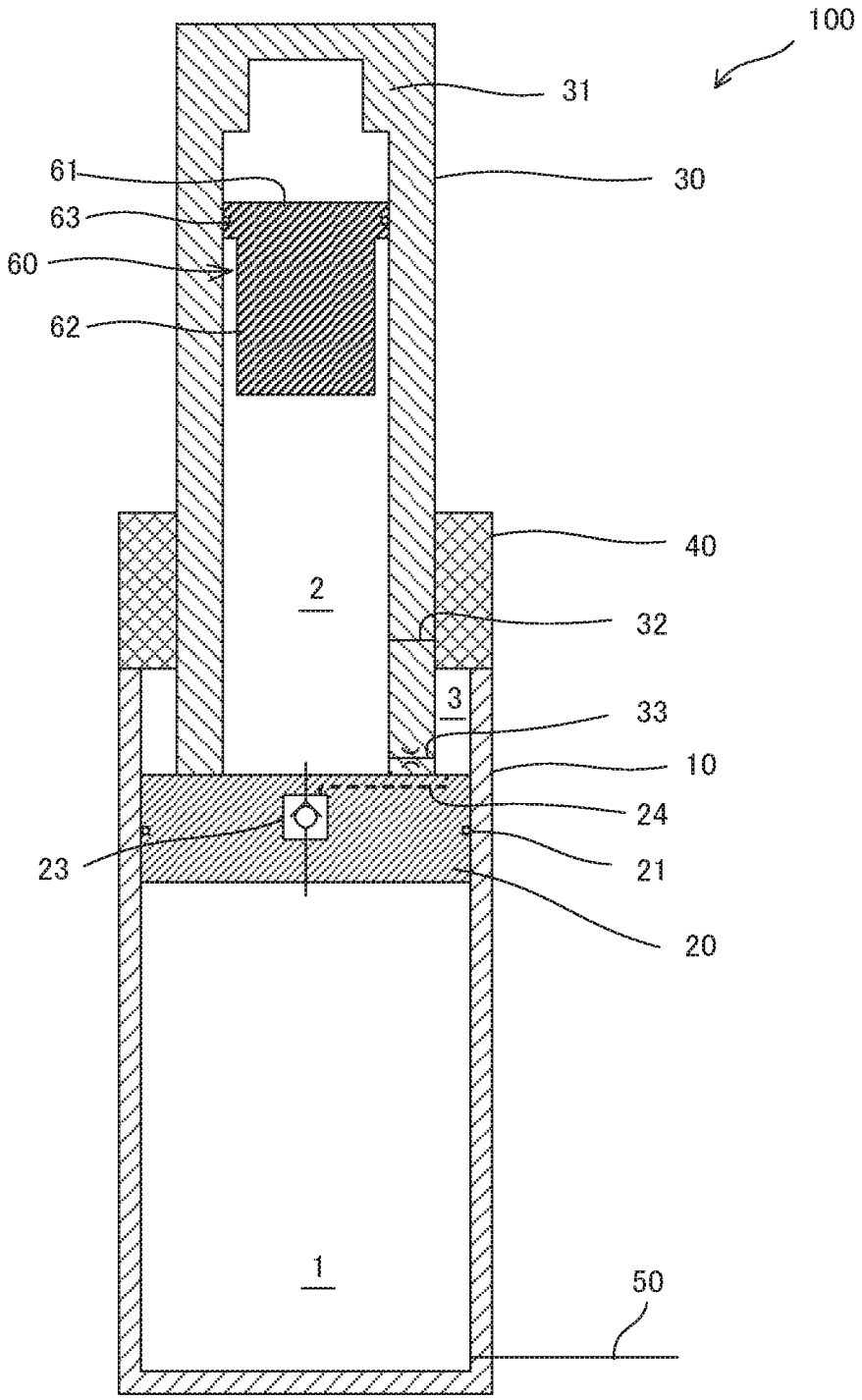
FIG. 2 is a cross-sectional view showing the fluid pressure cylinder according to the first embodiment of the present invention.

If the piston 20 further ascends, the communication passage 32 is blocked by the cylinder head 40 as shown in FIG. 2. After the communication passage 32 has been blocked, the working fluid corresponding to a reduction in the capacity of the cushioning chamber 3 caused by the ascent of the piston 20 flows into the in-rod chamber 2 via the throttle passage 33. As the throttle passage 33 applies resistance to the flow of the working fluid from the cushioning chamber 3 to the in-rod chamber 2, the pressure in the cushioning chamber 3 increases, and the ascent of the piston 20 is suppressed. In this way, the cushioning function is exerted. Furthermore, at this time, a high-pressure air is stored inside the reduced diameter part 31 due to the ascent of the free piston 60.

Thereafter, the cushioning function is exerted until a top dead center position of the piston 20, that is to say, the extension stroke end of the fluid pressure cylinder 100 is reached. This alleviates impact when the piston 20 hits the cylinder head 40.

Also, the pressure in the cushioning chamber 3 is supplied to the check valve 23 via the pilot passage 24. If the pilot pressure supplied to the check valve 23 exceeds the predetermined valve opening pressure due to the increase in the pressure in the cushioning chamber 3, the checking function of the check valve 23 is disabled. In this way, the working fluid in the driving chamber 1 flows into the in-rod chamber 2 via the check valve 23.

Therefore, each time the fluid pressure cylinder 100 undergoes the extension operation, the working fluid is supplied from the driving chamber 1 to the in-rod chamber 2. This makes it possible to prevent the cushioning function from declining due to a shortage of the working fluid inside the cushioning chamber 3.

On the other hand, if the working fluid in the driving chamber 1 is discharged from the supply/discharge passage 50, the piston 20 and the piston rod 30 descend under their own weights. The descent of the piston 20 increases the capacity of the cushioning chamber 3. Therefore, the working fluid in the in-rod chamber 2 flows into the cushioning chamber 3 via the throttle passage 33 and the communication passage 32. In association with a drop of the fluid level of the working fluid in the in-rod chamber 2, the free piston 60 slides downward. At this time, the pressure that was stored in the air at the time of extension of the fluid pressure cylinder 100 facilitates the descent of the free piston 60.

Although the working fluid in the in-rod chamber 2 flows into the cushioning chamber 3 at the time of the descent of the piston 20 in the above-described manner, as the capacity of the in-rod chamber 2 is set to be equal to or larger than the capacity of the cushioning chamber 3, there is no possibility that the descent of the piston 20 is prohibited by the descent of the free piston 60 to the lowest point before the fluid pressure cylinder 100 is placed in a fully retracted state.

The foregoing embodiment achieves the following effects.

The checking function of the check valve 23 is disabled as the pressure in the cushioning chamber 3 is supplied to the check valve 23 via the pilot passage 24. Consequently, the working fluid in the driving chamber 1 can be supplied to the in-rod chamber 2 via the check valve 23. Therefore, even if the working fluid leaks from the cushioning chamber 3 to the driving chamber 1 via the seal ring 21 on the piston 20, the in-rod chamber 2 can be replenished with the working fluid each time the fluid pressure cylinder 100 undergoes the extension operation. This makes it possible to prevent the cushioning function from declining due to a shortage of the working fluid inside the cushioning chamber 3.

Furthermore, the free piston 60 housed in the in-rod chamber 2 partitions the in-rod chamber 2 into the working fluid and the air. This makes it possible to prevent foaming of the working fluid when the working fluid in the in-rod chamber 2 increases and decreases in association with extension and retraction of the fluid pressure cylinder 100.

Furthermore, the free piston 60 causes the volume of the air to increase and decrease in accordance with the working fluid pressure in the in-rod chamber 2, thereby enabling the in-rod chamber 2 to function as an accumulator. At the time of retraction of the fluid pressure cylinder 100, a smooth motion can be facilitated by the stored, pressurized air pressing the free piston 60 downward.

Furthermore, the capacity of the in-rod chamber 2 is set to be equal to or larger than the capacity of the cushioning chamber 3 at the time of full retraction of the fluid pressure cylinder 100, which maximizes the cushioning chamber 3. Therefore, at the time of retraction of the fluid pressure cylinder 100, i.e., when the working fluid flows from the in-rod chamber 2 to the cushioning chamber 3, it is possible to prevent a situation in which the descent of the piston 20 is prohibited by the descent of the free piston 60 to the lowest point before the fluid pressure cylinder 100 is placed in the fully retracted state.

Next, a second embodiment will be described.

Figure 3:
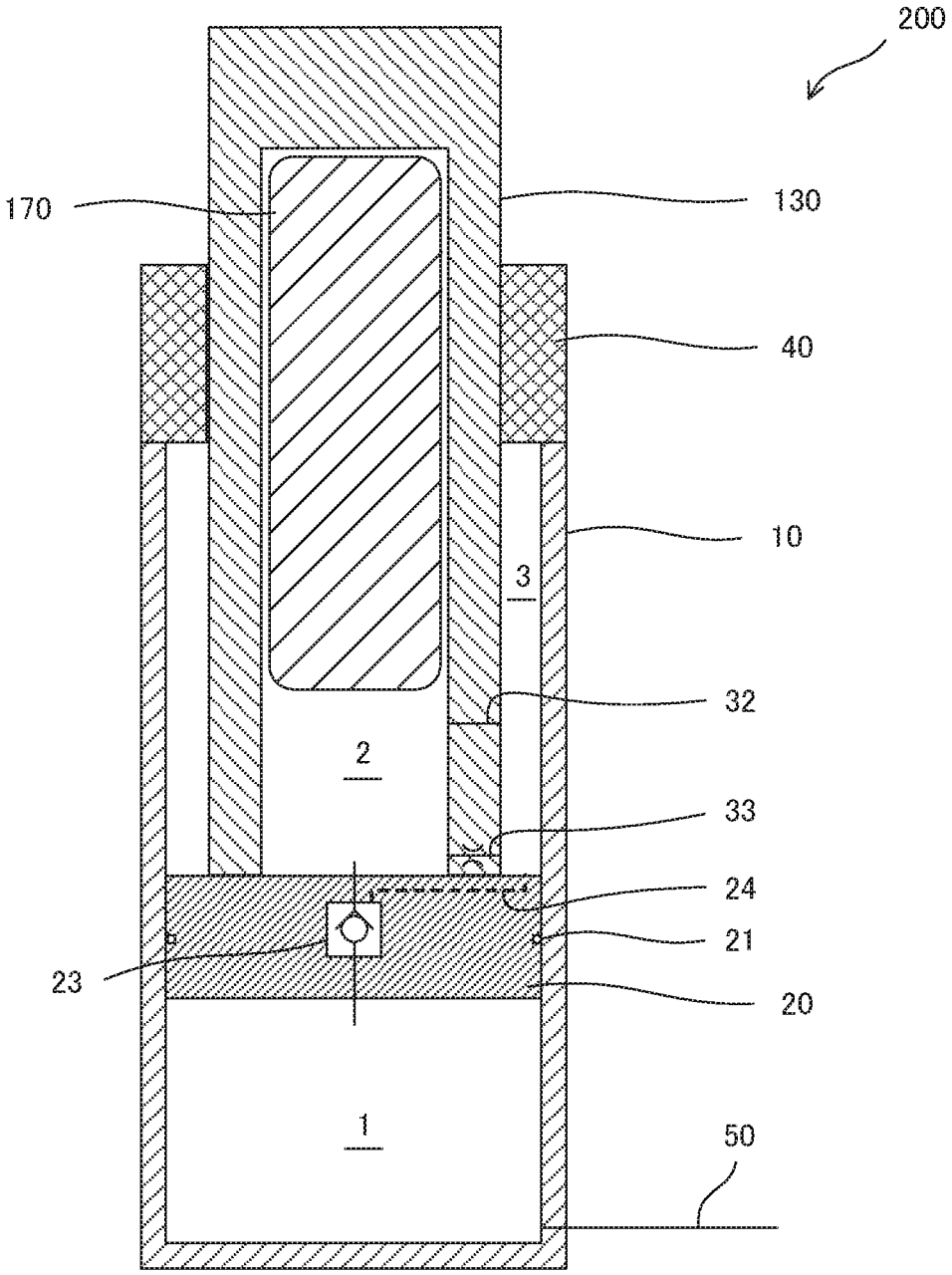
FIG. 3 is a cross-sectional view showing a fluid pressure cylinder according to a second embodiment of the present invention.

FIG. 3 is a cross-sectional view showing a fluid pressure cylinder 200 according to the present embodiment.

The present embodiment differs from the first embodiment in that a later-described boot 170 is provided in place of a free piston 60 according to the first embodiment, and also in the structure of an in-rod chamber 2. The present embodiment is the same as the first embodiment in other structures. Therefore, the following describes portions that differ from the first embodiment.

Unlike the first embodiment, a piston rod 130 according to the present embodiment does not have a reduced diameter part 31. The piston rod 130 is formed as a bottomed tube that has a uniform inner diameter along an axial direction.

Furthermore, in place of the free piston 60, the boot 170 is housed inside the piston rod 130. The inside of the boot 170 is filled with the air. The boot 170, which serves as a separator member, is formed by an expandable and contractible material, for example, resin, thin metal, and the like. In this way, the volume of the boot 170 changes in accordance with a change in the pressure in the in-rod chamber 2. That is to say, the boot 170 contracts as the pressure in the in-rod chamber 2 increases, whereas the boot 170 expands as the pressure in the in-rod chamber 2 decreases.

A dimension of the boot 170 in an up-down direction is set so as not to block an opening portion of a communication passage 32. In this way, opening portions of the communication passage 32 and a throttle passage 33 are always exposed to a side below the boot 170, regardless of the state of expansion and contraction of the boot 170.

A description is now given of operations of the fluid pressure cylinder 200.

FIG. 3 shows a state in which a working fluid is supplied from a fluid pressure source to a driving chamber 1 via a supply/discharge passage 50. Supply of the working fluid causes the pressure in the driving chamber 1 to increase. Accordingly, a piston 20 and the piston rod 130 are driven upward. In association with the ascent of the piston 20, the capacity of a cushioning chamber 3 decreases. Hence, the working fluid corresponding to the reduced capacity flows into the in-rod chamber 2 via the communication passage 32.

Meanwhile, as the in-rod chamber 2 communicates with the cushioning chamber 3 via the communication passage 32, the pressure in the in-rod chamber 2 increases in association with the increase in the pressure in the cushioning chamber 3. The increase in the pressure in the in-rod chamber 2 causes the boot 170 to contract while compressing the air.

Figure 4:
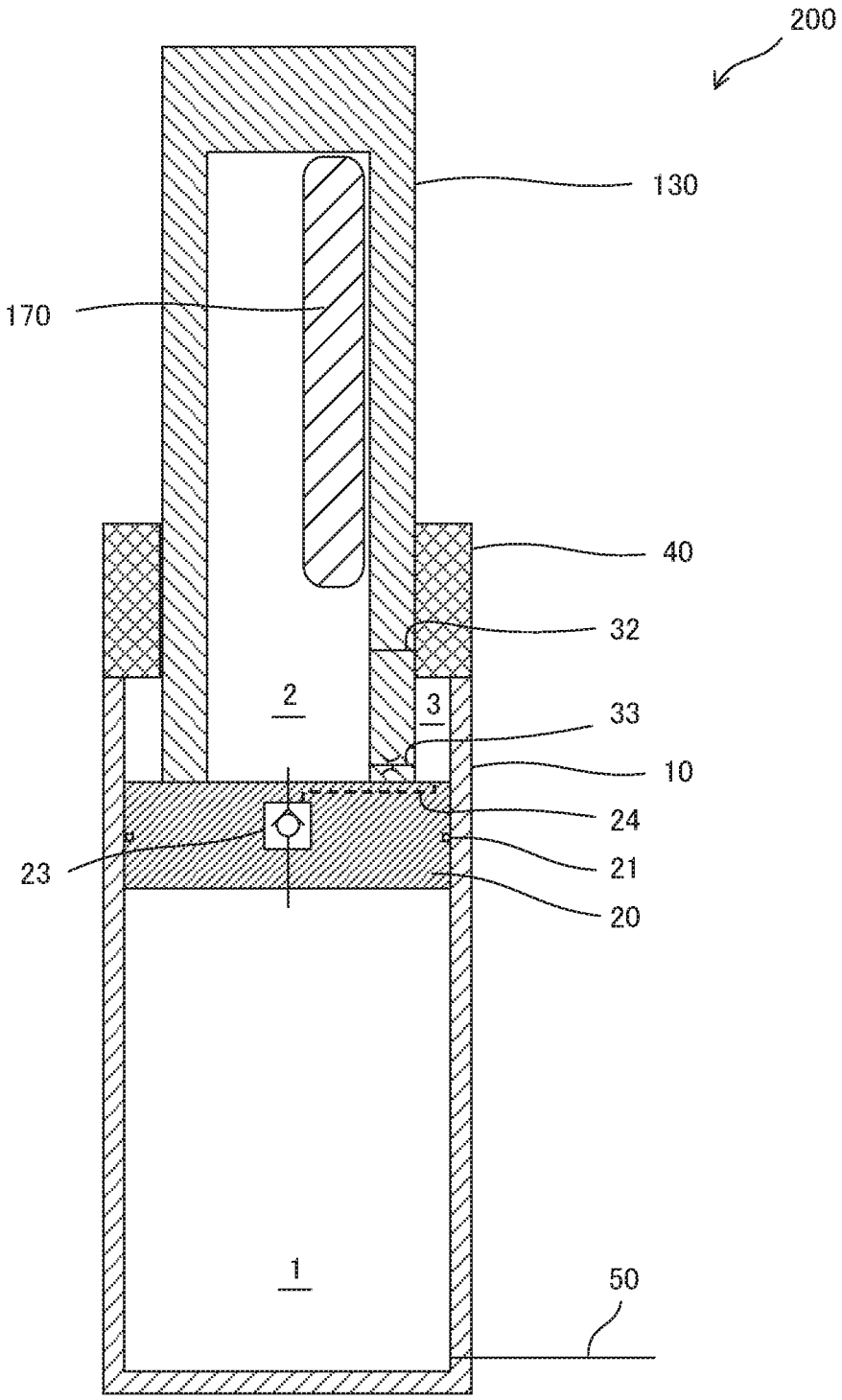
FIG. 4 is a cross-sectional view showing the fluid pressure cylinder according to the second embodiment of the present invention.

If the piston 20 further ascends, the communication passage 32 is blocked by a cylinder head 40 as shown in FIG. 4. After the communication passage 32 has been blocked, the working fluid corresponding to a reduction in the capacity of the cushioning chamber 3 caused by the ascent of the piston 20 flows into the in-rod chamber 2 via the throttle passage 33. As the throttle passage 33 applies resistance to the flow of the working fluid from the cushioning chamber 3 to the in-rod chamber 2, the pressure in the cushioning chamber 3 increases, and the ascent of the piston 20 is suppressed. In this way, a cushioning function is exerted. Furthermore, at this time, a high-pressure air is stored inside the boot 170.

Thereafter, the cushioning function is exerted until a top dead center position of the piston 20, that is to say, an extension stroke end of the fluid pressure cylinder 200 is reached. This alleviates impact when the piston 20 hits the cylinder head 40.

Also, the pressure in the cushioning chamber 3 is supplied to a check valve 23 via a pilot passage 24. If a pilot pressure supplied to the check valve 23 exceeds a predetermined valve opening pressure due to the increase in the pressure in the cushioning chamber 3, a checking function of the check valve 23 is disabled. In this way, the working fluid in the driving chamber 1 flows into the in-rod chamber 2 via the check valve 23.

Therefore, each time the fluid pressure cylinder 200 undergoes an extension operation, the working fluid is supplied from the driving chamber 1 to the in-rod chamber 2. This makes it possible to prevent the cushioning function from declining due to a shortage of the working fluid inside the cushioning chamber 3.

On the other hand, if the working fluid in the driving chamber 1 is discharged from the supply/discharge passage 50, the piston 20 and the piston rod 130 descend under their own weights. The descent of the piston 20 increases the capacity of the cushioning chamber 3. Therefore, the working fluid in the in-rod chamber 2 flows into the cushioning chamber 3 via the throttle passage 33 and the communication passage 32. In association with a drop of a fluid level of the working fluid in the in-rod chamber 2, the boot 170 expands.

Although the working fluid in the in-rod chamber 2 flows into the cushioning chamber 3 at the time of the descent of the piston 20 in the above-described manner, as the capacity of the in-rod chamber 2 is set to be equal to or larger than the capacity of the cushioning chamber 3, there is no possibility that the descent of the piston 20 is prohibited by the boot 170 expanding to the point where it is equivalent in volume to the in-rod chamber 2 before the fluid pressure cylinder 200 is placed in a fully retracted state.

The foregoing embodiment achieves the following effects.

The boot 170 housed in the in-rod chamber 2 separates the working fluid and the air in the in-rod chamber 2 from each other. This makes it possible to prevent foaming of the working fluid when the working fluid in the in-rod chamber 2 increases and decreases in association with extension and retraction of the fluid pressure cylinder 200.

Furthermore, the boot 170 expands and contracts in accordance with a working fluid pressure in the in-rod chamber 2, thereby enabling the in-rod chamber 2 to function as an accumulator. At the time of retraction of the fluid pressure cylinder 200, a smooth motion can be facilitated by causing the working fluid in the in-rod chamber 2 to flow into the cushioning chamber 3 more smoothly with the stored, pressurized air.

This concludes the description of the embodiment of the present invention. It should be noted that the above-described embodiment merely illustrates one application example of the present invention, and is not intended to limit a technical scope of the present invention to specific configurations of the above-described embodiment.

For example, while the above-described embodiments have illustrated a case in which the free piston 60 or the boot 170 is used to separate the working fluid and the air in the in-rod chamber 2 from each other, the working fluid and the air may be separated from each other by other structures.

Furthermore, while the above-described embodiments attempt to prevent foaming of the working fluid by providing the free piston 60 or the boot 170 in the in-rod chamber 2, a shortage of cushioning oil can be prevented without providing these members.

Furthermore, while the capacity of the in-rod chamber 2 is set to be equal to or larger than the capacity of the cushioning chamber 3 at the time of full retraction of the fluid pressure cylinders 100, 200, which maximizes the cushioning chamber 3, in the above-described embodiments, the capacity of the in-rod chamber 2 may be smaller than the maximum capacity of the cushioning chamber 3 in the case of a fluid pressure cylinder in which the piston 20 does not descend to a bottom portion of the cylinder tube 10.

This application claims priority based on Japanese Patent Application No. 2013-141622 filed with the Japan Patent Office on Jul. 5, 2013, the entire contents of which are incorporated into this specification.

The invention claimed is:

1. A single-acting fluid pressure cylinder that extends upward in accordance with supply of a working fluid to a driving chamber below a piston sliding inside a cylinder tube, and that has a cushioning function for suppressing an extension operation before the piston reaches an extension stroke end, the fluid pressure cylinder comprising:

a piston rod that is joined to an upper portion of the piston with an in-rod chamber defined between the piston rod and the piston;

a cushioning chamber defined between the piston rod and the cylinder tube, the cushioning chamber being configured to decrease in capacity in accordance with extension of the fluid pressure cylinder;

a communication passage formed in the piston rod, the communication passage being configured to allow the cushioning chamber and the in-rod chamber to communicate with each other;

a throttle passage formed below the communication passage, the throttle passage being configured to exert the cushioning function by applying resistance to a flow of the working fluid from the cushioning chamber to the in-rod chamber;

a check valve provided in the piston, the check valve being configured to allow the in-rod chamber and the driving chamber to communicate with each other, the check valve being configured to have a checking function for permitting only a flow of the working fluid from the in-rod chamber to the driving chamber; and a pilot passage formed in the piston, the pilot passage being configured to disable the checking function by guiding a pressure in the cushioning chamber to the check valve as a pilot pressure.

2. The fluid pressure cylinder according to claim 1, further comprising a separator member housed in the in-rod chamber to partition the in-rod chamber into the working fluid and air, the separator member being configured to increase and decrease a volume of the air in accordance with a working fluid pressure in the in-rod chamber.

3. The fluid pressure cylinder according to claim 2, wherein the separator member is a free piston that is slidable up and down in the in-rod chamber, and the air is stored above the free piston.

4. The fluid pressure cylinder according to claim 2, wherein the separator member is an expandable and contractible boot, and the air is stored inside the boot.

5. The fluid pressure cylinder according to claim 1, wherein a capacity of the in-rod chamber is equal to or larger than a capacity of the cushioning chamber at a time of full retraction of the fluid pressure cylinder.

* * * * *